US006858315B2

(12) United States Patent
Khan et al.

(10) Patent No.: US 6,858,315 B2
(45) Date of Patent: Feb. 22, 2005

(54) LOW VOC ASPHALT PRIMER

(75) Inventors: Amir G. Khan, Pequannock, NJ (US); Elizabeth Machado, Union, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/255,242

(22) Filed: Sep. 26, 2002

(65) Prior Publication Data

US 2004/0071995 A1 Apr. 15, 2004

(51) Int. Cl.[7] ..... C08L 95/00
(52) U.S. Cl. ..... 428/489; 106/278; 106/284.2
(58) Field of Search ..... 428/489; 106/273.1, 106/278, 284.2

(56) References Cited

U.S. PATENT DOCUMENTS

| | | | | | |
|---|---|---|---|---|---|
| 4,430,465 | A | * | 2/1984 | Abbott | 524/64 |
| 4,493,800 | A | * | 1/1985 | Furutaka et al. | 558/343 |
| 5,362,316 | A | * | 11/1994 | Paradise | 106/278 |
| 6,291,571 | B1 | * | 9/2001 | Fisher | 524/464 |
| 6,403,659 | B1 | * | 6/2002 | Boyer et al. | 516/52 |

* cited by examiner

*Primary Examiner*—Kevin M. Bernatz
(74) *Attorney, Agent, or Firm*—Marilyn J. Maue; William J. Davis

(57) ABSTRACT

An asphalt primer composition which comprises between about 0.8 and about 45 wt. % of a halobenzotrifluoride and between about 55 and about 92 wt. % of liquid cutback asphalt normally employed in building construction and road paving and having a VOC below 200 g/l.

9 Claims, No Drawings

LOW VOC ASPHALT PRIMER

FIELD OF THE INVENTION

This invention is particularly directed to undercoating solutions having low volatile organic component (VOC) concentration and a flash point above 100° F.

BACKGROUND OF THE INVENTION

In the past, roofing surfaces have been coated with cutback asphalt or asphaltic primer compositions containing undesirably high levels of VOC above 340 g/liter. The evaporation of these volatiles, e.g. naphthas, kerosene, lower paraffins etc. at normal climate temperatures, diminishes the coating stability, surface adhesion and roof deck resistance to deterioration under atmospheric conditions and may also create worker health hazards due to vaporization of volatile materials during installation. Several methods and cutback compositions have been proposed for the purpose of reducing the VOC content; however, these have been unable to attain the desired 200 g/liter maximum of VOC concentration or are associated with other problems, such as extended cure time which interrupts work on the installation of a roof.

Accordingly, it is an object of this invention to provide a completely stable cutback asphalt primer composition having a maximum VOC concentration of 200 g/l or less and a cure time of not more than a few minutes.

Another object is to provide a solvent for cutback asphalts having a flash point above 100° F.

Still another object is to provide a liquid cutback asphalt primer having properties well within current needs and specifications.

These and other objects and advantages will become apparent from the following description and disclosure.

SUMMARY OF THE INVENTION

In accordance with this invention there is provided a halobenzotrifluoride as a sole solvent or co-solvent for a raw or liquid cutback asphalt having a flash point above 100° F. and a VOC concentration not more than a maximum of 200 g/l as well as an improved cutback asphalt primer composition for roof installations.

DETAILED DESCRIPTION OF THE INVENTION

The improved primer composition of this invention comprises a raw or liquid cutback asphalt containing between about 0.8 and about 45 wt. % halobenzotrifluoride. The liquid cutback asphalt is a raw asphalt generally containing a liquefying amount of from 15 to 50 wt. %, more often 25–35 wt. %, of a volatile organic solvent, for example an aromatic solvent such as naphtha, kerosene, mineral spirits, gas oil, paraffins boiling below about 100° F. or mixtures thereof.

The cutback asphalt solvent additive of this invention is preferably a benzotrifluoride having a halo substituent in the para position on the benzene ring and is most desirably parabromo- or parachloro-benzotrifluoide or a mixture thereof, particularly p-bromobenzotrifluoride. Between about 0.8 and about 45 wt. %, preferably between about 3 and about 20 wt. %, of the halobenzotrifluoride is added to the liquid cutback asphalt. In most instances, from about 6 to about 15 wt. % of the halobenzotrifluoride is an amount sufficient to lower the VOC concentration below a maximum 200 g/l which is well within desired specifications.

The liquid cutback asphalt is one conventionally employed as a primer undercoating in siding and roofing applications including "mop on" built-up roofing (BUR), shingling or acoustical installations. Without further fractionation or at least partial replacement of the asphalt volatile solvent materials, prior primer compositions do not provide desired adhesion between an overlaid sheet and the substrate. By addition of the present halobenzotrifluoride solvent, the volatile content is reduced to 200 g/l maximum or less and the flash point of the liquid cutback asphalt is raised by at least 5°. Further, the tacky modified primer composition described herein provides additional benefits, such as compatibility with a wide variety of substrate surfaces including metal, felt, fiber board, plaster board and wood substrates. When coated over a plywood roof deck, the present composition lubricates and preserves the wood substrate.

The present modified primer, which is a tacky, oily substance, is coated on the substrate as a layer in a thickness of from about 0.75 to about 12 mils, preferably a thickness of from 1–7 mils on a roof deck and then covered with one or more top layers of asphaltic material to provide a weather resistant exposed surface, e.g. a granule coated membrane on the weather exposed surface of the installation according with current specifications. More particularly, according to current specifications, installation generally involves applying a tackifying amount of the present primer composition to a substrate such as a new roof deck or an existing roof, or a siding or acoustical base surface. By way of illustration on a new roof, after applying the primer composition, an asphaltic base sheet is nailed to the deck through the layer of primer and a weather resistant, bitumen modified cap sheet is torched over the base sheet to complete the installation. The resulting installation possesses markedly reduced VOC concentration, rapid drying within 1–5 minutes and a flash temperature above 100° F.

Having generally described the invention, reference is had to the following examples which illustrate preferred embodiments and comparisons but which are not to be construed as limiting to the scope of the invention as set forth above and in the appended claims.

EXAMPLE

To liquid cutback asphalt, containing 30 wt. % of mineral spirits solvent, was added 10 wt. % of p-bromobenzotrifluoride to provide a liquid primer having a VOC concentration of 186 g/l and a flash point of 110° F. The resulting primer composition was rolled at ambient temperature on a plywood roof deck in a 6 mil thick layer. Alternatively the composition can be sprayed or poured on the deck. The primer layer was then covered with an asphaltic base sheet which was nailed to the deck through the primer under ambient temperature conditions. A granular surfaced bitumen cap sheet was then applied over the secured base sheet by torching.

The above experiment was repeated except that a non-modified primer, namely liquid cutback asphalt of 70 wt. % asphalt and 30 wt. % mineral spirits solvent was substituted for the halobenzotrifluoride solvent described above. The resulting primer had a VOC concentration of about 450 g/l and showed inferior adhesion to the roof deck.

It will be understood that many modifications and alterations can be made in the above primer composition by addition of conventional excipients such as a thickener or diluent to alter its viscosity, or adhesive such as a pressure sensitive adhesive, without departing from the scope of this invention.

What is claimed is:

1. An asphalt primer composition having a VOC below 200 g/liter which comprises a liquid asphalt containing between about 3 and about 20 wt. % of a halobenzotrifluoride solvent selected from the group consisting of bromobenzotrifluoride, chlorobenzotrifluoride and mixtures thereof, wherein said liquid asphalt is a cutback asphalt containing a solvent mixture of said halobenzotrifluonde and a co-solvent selected from the group consisting of kerosene, mineral spirits, gas oil, paraffins boiling below 120° F. and mixtures thereof.

2. The primer composition of claim 1 wherein said halobenzotrifluoride is a para-halobenzotrifluoride.

3. The primer composition of claim 1 wherein said solvent is parabromobenzotrifluoride.

4. The asphalt primer composition of claim 1 containing between about 6 and about 15 wt. % of the halobenzotrifluoride.

5. The asphalt primer composition of claim 1 having a VOC concentration of less than a maximum of 200 g/l and a flash point above 100° F.

6. The composition of claim 1 coated on a substrate in an effective tackifying amount to provide a primer coating having a VOC less than 200 g/l maximum.

7. The composition of claim 1 coated on a substrate in a coating thickness of between about 0.75 and about 12 mils.

8. The composition of claim 1 coated on a substrate in a coating thickness of between about 1 and about 7 mils.

9. The composition of claim 1 coated in an effective tackifying amount on a roof deck.

* * * * *